US008539706B1

(12) United States Patent
Vieweg et al.

(10) Patent No.: US 8,539,706 B1
(45) Date of Patent: Sep. 24, 2013

(54) RECOIL REDUCING FIREARM SYSTEM

(76) Inventors: Thomas J. Vieweg, Lloyd Harbor, NY (US); Virgil Tripp, Bastrop, TX (US)

( * ) Notice: Subject to any disclaimer, the term of this patent is extended or adjusted under 35 U.S.C. 154(b) by 0 days.

(21) Appl. No.: 13/495,197

(22) Filed: Jun. 13, 2012

(51) Int. Cl.
*F41A 25/00* (2006.01)

(52) U.S. Cl.
USPC ..... 42/1.06; 89/198

(58) Field of Classification Search
USPC ..... 42/1.06, 74, 97; 89/14.3, 198, 199
See application file for complete search history.

(56) References Cited

U.S. PATENT DOCUMENTS

| | | | | |
|---|---|---|---|---|
| 1,066,206 | A * | 7/1913 | Jolidon | 89/144 |
| 2,522,192 | A * | 9/1950 | Porter | 89/198 |
| 2,921,503 | A * | 1/1960 | Browning | 89/195 |
| 3,204,531 | A * | 9/1965 | Swieskowski | 89/199 |
| 3,866,516 | A * | 2/1975 | Frisoli | 89/190 |
| 5,069,110 | A * | 12/1991 | Menck | 89/198 |
| 2008/0196289 | A1 * | 8/2008 | Mantas | 42/1.06 |
| 2012/0048104 | A1 * | 3/2012 | Bryant et al. | 89/191.01 |
| 2012/0167425 | A1 * | 7/2012 | Buschow et al. | 42/14 |

FOREIGN PATENT DOCUMENTS

DE 10051708 A1 * 5/2002

* cited by examiner

*Primary Examiner* — Gabriel Klein

(57) ABSTRACT

A frame is adapted to be held by a user. A barrel is coupled to the base. A slide is slidably received on the barrel and adapted for rearward movement in response to firing. A full-time spring is operable for abating recoil during the entire rearward movement of the slide including primary and secondary portions of the rearward movement. A recoil reducer includes a part-time spring. The part-time spring is operable for abating recoil during the primary portion of the rearward movement. The recoil reducer also includes an engager. The engager is operable in response to movement of the slide between the primary and secondary portions of the rearward movement to terminate operation of the part-time spring.

6 Claims, 5 Drawing Sheets

FIG. 1
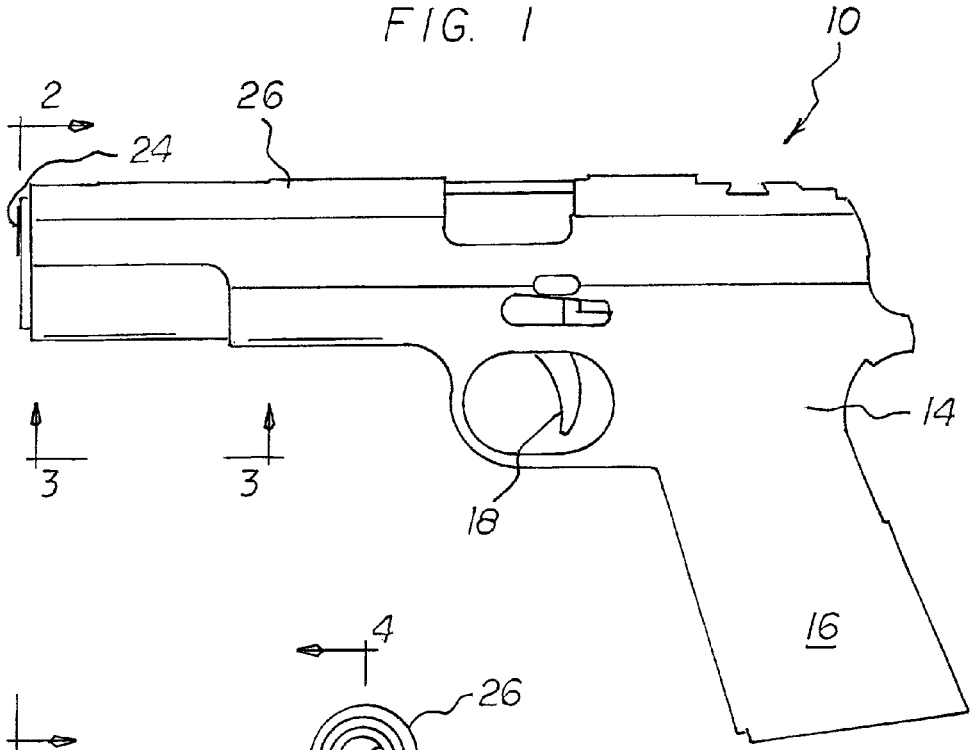
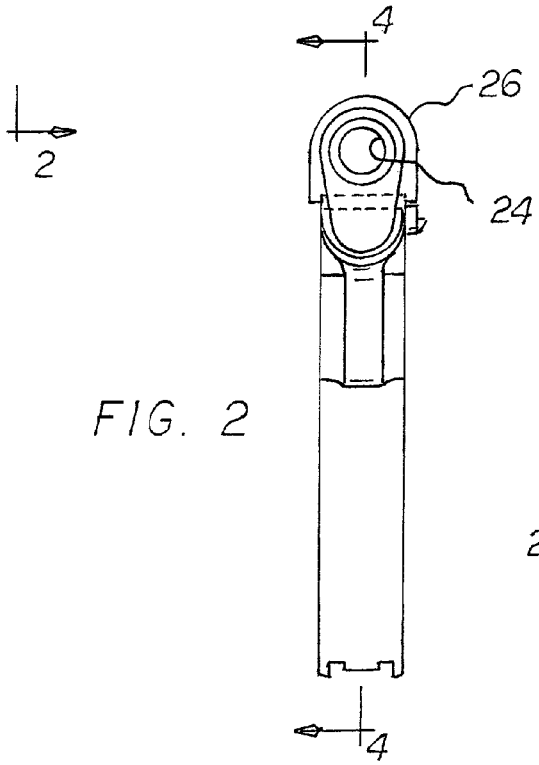
FIG. 2
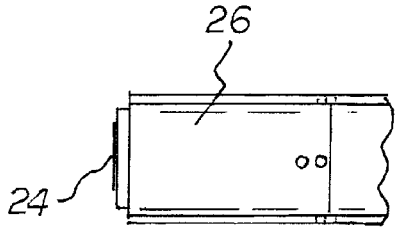
FIG. 3

FIG. 4
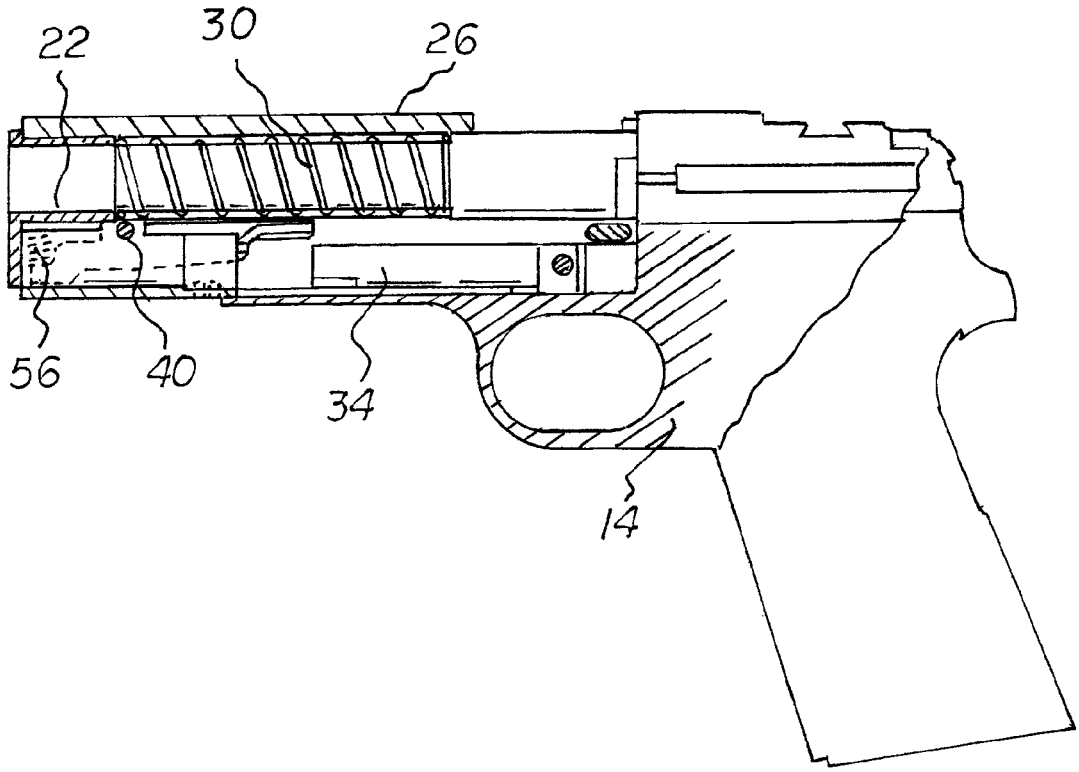
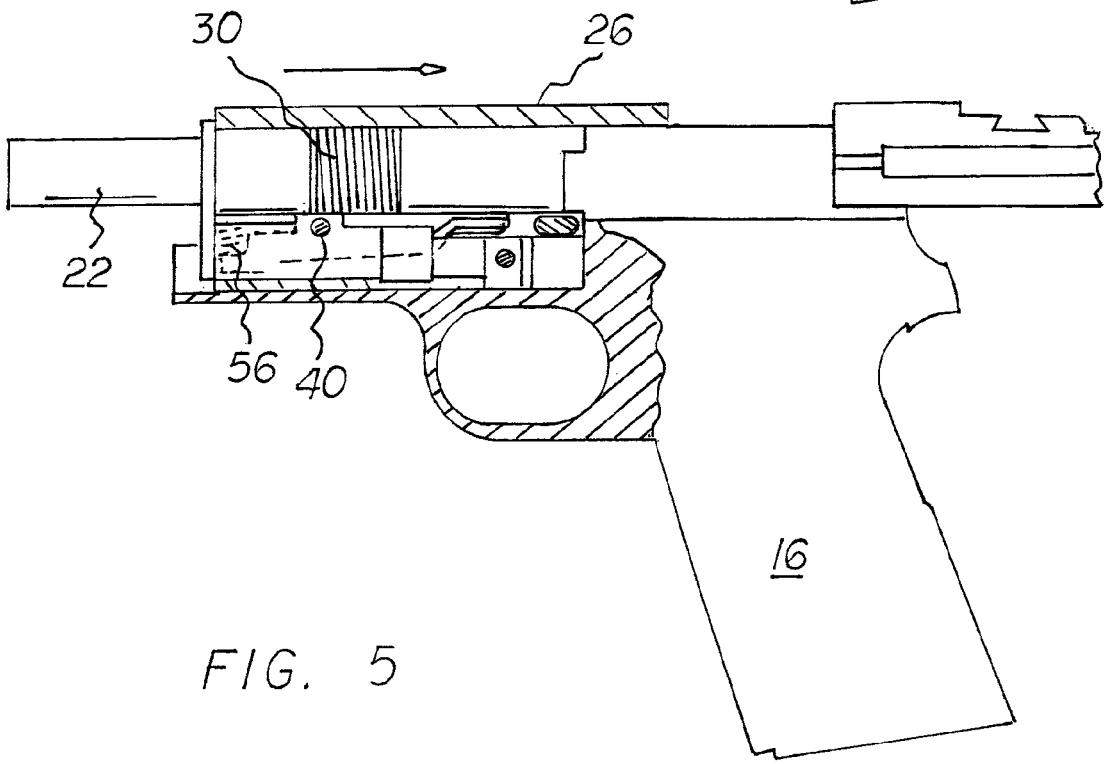
FIG. 5

FIG. 6
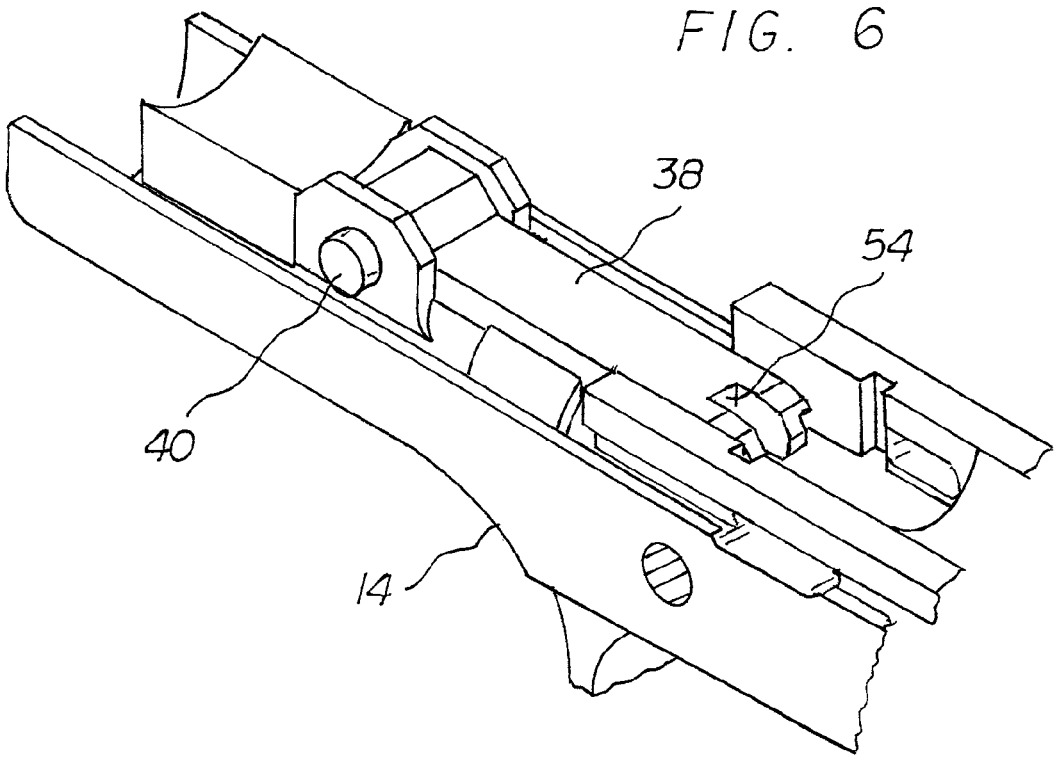
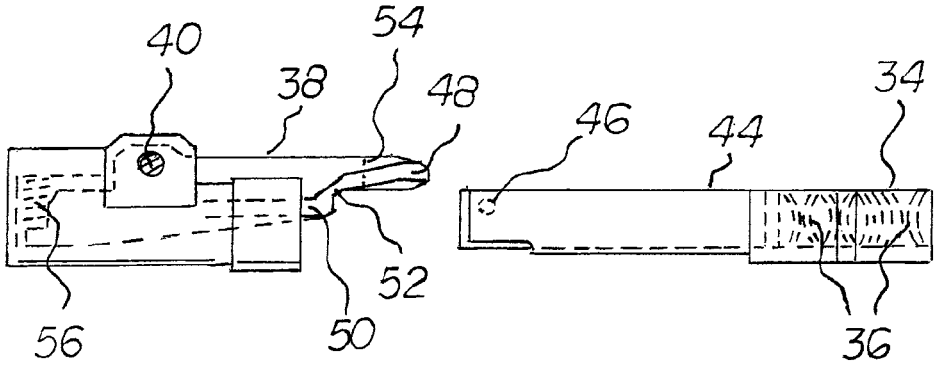
FIG. 7

FIG. 8
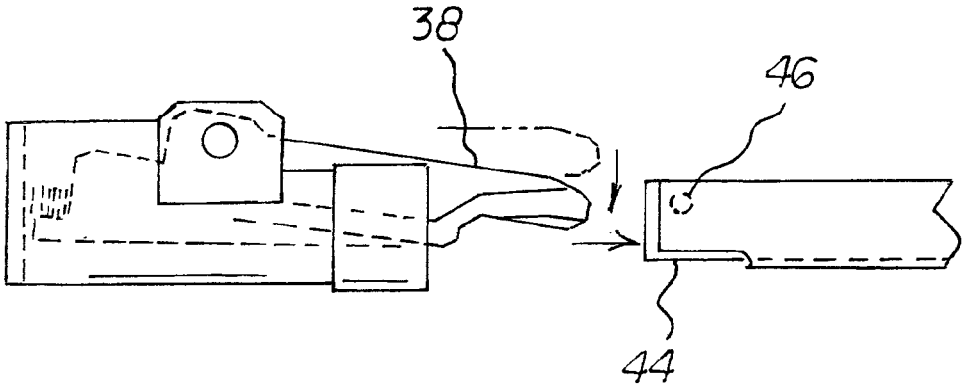
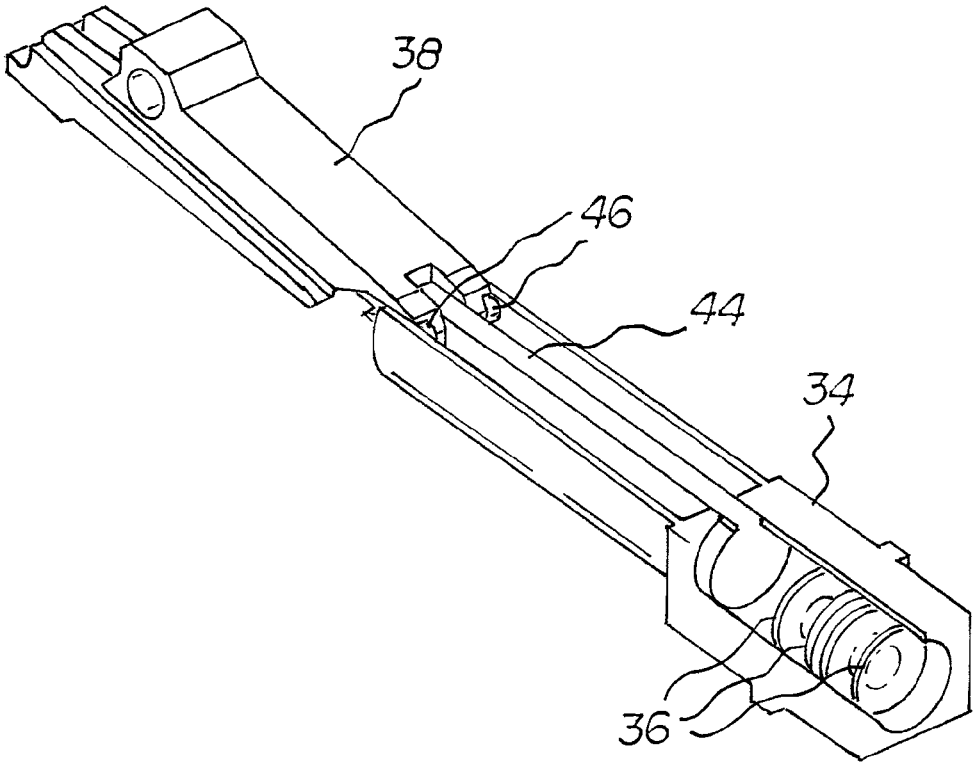
FIG. 9

FIG. 10
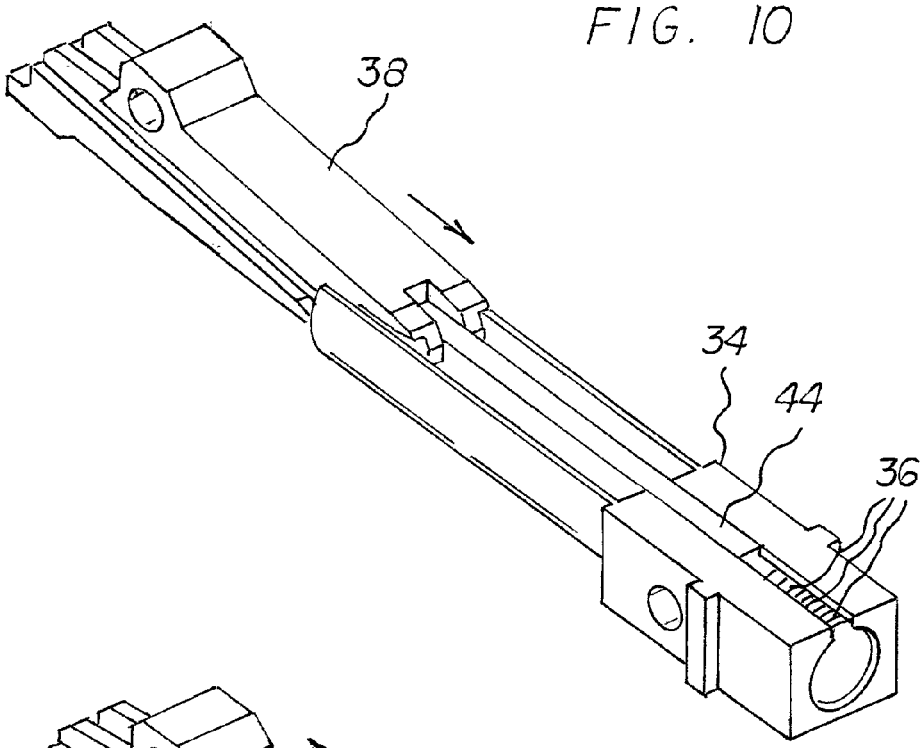
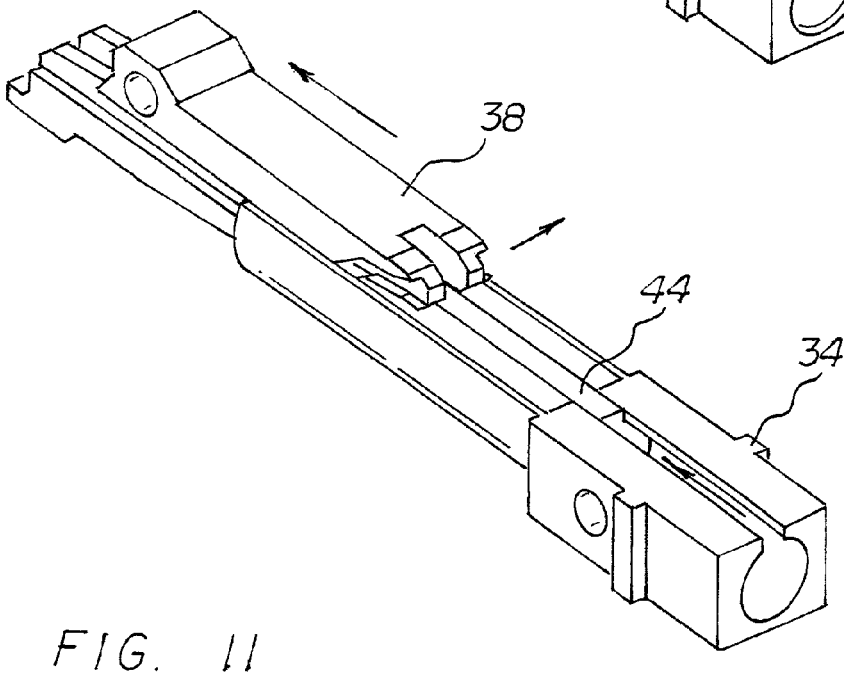
FIG. 11

RECOIL REDUCING FIREARM SYSTEM

BACKGROUND OF THE INVENTION

Field of the Invention

The present invention relates to a recoil reducing firearm system and more particularly pertains to the reducing of force necessary to initially manually pull back the slide prior to a first shot being fired and the minimizing of recoil during all shots and for the returning of energy as a counterbalancing force during use, the reducing of force and the minimizing of recoil and the returning of energy being done in a safe, convenient and economical manner.

SUMMARY OF THE INVENTION

In view of the disadvantages inherent in the known types of firearm systems of known designs and configurations now present in the prior art, the present invention provides an improved recoil reducing firearm system. As such, the general purpose of the present invention, which will be described subsequently in greater detail, is to provide a new and improved recoil reducing firearm system and method which has all the advantages of the prior art and none of the disadvantages.

To attain this, the present invention essentially comprises a recoil reducing firearm system. A frame is adapted to be held by a user. A barrel is coupled to the base. A slide is slidably received on the barrel and adapted for rearward movement in response to firing. A full-time spring is operable for abating recoil during the entire rearward movement of the slide including primary and secondary portions of the rearward movement. A recoil reducer includes a part-time spring. The part-time spring is operable for abating recoil during the primary portion of the rearward movement. The recoil reducer also includes an engager. The engager is operable in response to movement of the slide between the primary and secondary portions of the rearward movement to terminate operation of the part-time spring.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved recoil reducing firearm system which has all of the advantages of the prior art firearm systems of known designs and configurations and none of the disadvantages.

It is another object of the present invention to provide a new and improved recoil reducing firearm system which may be easily and efficiently manufactured and marketed.

It is further object of the present invention to provide a new and improved recoil reducing firearm system which is of durable and reliable constructions.

An even further object of the present invention is to provide a new and improved recoil reducing firearm system which is susceptible of a low cost of manufacture with regard to both materials and labor, and which accordingly is then susceptible of low prices of sale to the consuming public, thereby making such recoil reducing firearm system economically available to the buying public.

Even still another object of the present invention is to provide a recoil reducing firearm system for the reducing of force necessary to initially manually pull back the slide prior to a first shot being fired and the minimizing of recoil during all shots and for the returning of energy as a counterbalancing force during use, the reducing of force and the minimizing of recoil and the returning of energy being done in a safe, convenient and economical manner.

Lastly, it is an object of the present invention to provide a new and improved recoil reducing semi-automatic pistol system for the reducing of force necessary to initially manually pull back the slide prior to a first shot being fired and the minimizing of recoil during all shots and for the returning of energy as a counterbalancing force during use, the reducing of force and the minimizing of recoil and the returning of energy being done in a safe, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a recoil reducing firearm system constructed in accordance with the principles of the present invention.

FIG. 2 is a front view of the system taken along line 2-2 of FIG. 1.

FIG. 3 is a bottom view of a portion of the system taken along line 3-3 of FIG. 1.

FIG. 4 is a cross sectional view of the system taken along line 4-4 of FIG. 2.

FIG. 5 is a cross sectional view of the system similar to FIG. 4 but with the slide withdrawn.

FIG. 6 is a perspective illustration of the recoil reducing assembly of FIGS. 4 and 5 with compression occurring.

FIG. 7 is a side elevational view of the recoil reducing assembly at rest prior to firing.

FIG. 8 is a side elevational view of the recoil reducing immediately after firing.

FIGS. 9, 10 and 11 are perspective illustrations of the recoil reducing assembly showing the components at various locations during slide movement, FIG. 9 at the start of engagement during the primary portion of the slide movement, FIG. 10 between the primary and secondary portions of the slide movement, FIG. 11 during the secondary portion of the slide movement.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved recoil reducing firearm system embodying the principles and concepts of the present invention and generally designated by the reference numeral 10 will be described.

The present invention, the recoil reducing firearm system 10 is comprised of a plurality of components. Such components in their broadest context include a frame, a barrel, a slide, a full-time spring and a recoil reducer. Such components are individually configured and correlated with respect to each other so as to attain the desired objective.

First provided is a frame 14. The frame has a grip 16. The grip is adapted to be held by a user. The frame has a trigger 18. The trigger is adapted to be squeezed by the user. In this manner a bullet is fired.

A fixed barrel 22 is provided. The fixed barrel is coupled to the frame. The barrel has rifling.

A slide 26 is provided next. The slide is slidably received upon the barrel. In this manner reciprocable movement is allowed. The slide is adapted for an opening rearward movement in response to firing. The slide is adapted for a closing forward movement following the rearward movement. The rearward movement includes a primary portion and a secondary portion.

Further provided is a coil spring 30. The coil spring surrounds the barrel. The coil spring functions as a full-time spring. The coil spring is of a reduced value operable for reducing to a maximum of 10 pounds the force necessary for an initial manual pull back of the slide prior to a first shot. The coil spring is adapted to assist in the abating of recoil during the entire rearward and forward movement of the slide following firing.

Provided last is a recoil reducing assembly. The recoil reducing assembly includes a housing 34. The housing has a plurality of cupped spring washers 36 within the housing. Cupped spring washers are also known as Belleville washers, coned-disc springs, conical spring washers, and disc springs. The cupped spring washers are provided in combinations of series and parallel for functioning as a part-time spring operable for the abating of recoil during at least a part of the primary portion of the rearward movement of the slide and for the not abating of recoil during the secondary portion of the rearward movement of the slide. The recoil reducing assembly also includes a pendulum/pawl 38. A horizontal pivot pin 40 is provided. The horizontal pivot pin is mounted in the slide. The pendulum/pawl is coupled to the slide for linear and rotational movement about the horizontal pivot pin. The pendulum/pawl is operable to initiate operation and compression of the cupped spring washers in response to movement of the slide.

The recoil reducing assembly also includes a blade/piston 44. The blade/piston operatively couples the pendulum/pawl and the cupped spring washers when the slide moves during the primary portion of the rearward movement of the slide. Laterally spaced left and right projections 46 are provided. The projections are provided in the housing. Laterally spaced left and right initial upper raceways 48 are provided. Final lower raceways 50 are also provided. Angled intermediate raceways 52 are provided. The intermediate raceways are provided in the pendulum/pawl. The intermediate raceways slidably receive the projections. A central recess 54 is provided. The central recess is provided between the left and right raceways. A firing of the firearm functions to pivot the pendulum/pawl downwardly. In this manner a first rearward movement of the slide will be with the upper raceways receiving the projections and the recess receiving and pushing the blade/piston the cupped spring washers. In this manner recoil is abated. In this manner a second rearward movement of the slide will be with the angled intermediate raceways. The intermediate raceways receive the projections to pivot the pendulum/pawl upwardly for disengaging the blade/piston from the cupped spring washers to decompress the cupped spring washers. In this manner a third rearward movement of the slide will be with the projections in the final lower raceways.

Additional springs 56 are provided. The additional springs tend to pivot the pendulum/pawl upwardly. The slide and the pendulum/pawl and the blade/piston and the cupped spring washers are adapted to return energy to the frame as a counterbalancing force during at least a part of the secondary portion of the rearward movement of the slide. The initial manual pull back of the slide is with the projections in the lower recesses and with upper recesses not receiving the projections and with the cupped spring washes not being compressed.

Although a few weaker calibers do not, most semi-automatic self-loading pistols have excess energy to operate the slide.

1. As the slide opens, the problem is excess slide velocity, excess recoil, and excess shock of stopping the slide mass at the end of its stroke. This makes the pistol difficult to control.

2. Pistol designers select very strong recoil springs in an attempt to control slide velocity. This makes the pistol difficult to operate by hand.

3. As the slide closes, its mass is returned with excess force by the excessively strong spring. The problem here is that the sight alignment for the next shot is disturbed at the worst possible time of closing.

Typical recoil spring systems are substantially linear in force/deflection. That is, the more the spring is compressed, the stronger it gets. It is weakest in battery/closed position and strongest at full stroke/open position. This the nature of a compression spring. Pistol designers recognize this and often augment the force of the compression spring with tilting barrels, rotating breeches, or gas retard pistons. Although they can help, none of these methods really solves the problems.

The present invention solves all three of these problems by having the greatest resistive force earlier in the slide stroke followed by a lessening of force as the slide approaches end stroke. We reduce strength of the typical recoil spring for ease of hand operation and reduced closing shock. This minimizes recoil during the opening stroke and minimizes shock at the end of the stroke.

The present invention accomplishes this with a new part-time secondary spring system working in conjunction with a relatively light full-time recoil spring. An inertia control device makes the strong part-time spring engage only during live fire. This same mechanism ignores the part-time spring during hand cycling and the operator only encounters a pleasantly light recoil spring.

In a typical semi-automatic pistol, the slide converts most or all of its opening energy into compressing the recoil spring, and then, the compressed spring returns that same energy back into the closing slide. The present invention takes the energy from the part-time spring and releases it forward of the frame while the slide is still moving rearward. This becomes a counteracting force. When weight is added for the part-time spring to return, it becomes a counterbalanced force. The two fold difference here is returning energy to the frame, not the slide, and doing it while the slide is still traveling rearward.

Attributes that collectively define the present invention are as follows:

1. Part-time spring works in conjunction with typical full-time spring.
2. Part-time spring is positively activated and positively deactivated by an inertia control device working with a raceway.
3. Stored energy is returned forward to the frame, not to the slide.
4. This stored energy is returned forward to the frame while the slide is still moving rearward thereby counteracting without weight or counterbalanced with weight.
5. The slide encounters more resistance early/mid stroke than at the end of the stroke as is typical.
6. There is an operational distinction between live fire and hand cycling. The part-time spring does not function during hand cycling.
7. The inertia control module is independently slide fixed.
8. The part-time spring module with engagement/disengagement raceway is independently frame fixed.
9. The strength and duration of the part-time spring may be easily altered.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A recoil reducing firearm system comprising:

a frame adapted to be held by a user;

a barrel coupled to the frame;

a slide slidably received on the barrel and adapted for rearward movement in response to firing;

a full-time spring operable for abating recoil during the entire rearward movement of the slide including primary and secondary portions of the rearward movement; and a recoil reducer including a housing with a part-time spring within the housing, the part-time spring operable for abating recoil during the primary portion of the rearward movement, the recoil reducer also including a pendulum coupled to the slide for linear and rotational movement, the pendulum being operable to initiate operation and compression of the part-time spring in response to movement of the slide during the primary portion of the rearward movement of the slide, the pendulum also operable in response to movement of the slide between the primary and secondary portions of the rearward movement to terminate operation of the part-time spring, the recoil reducer also including a piston operatively coupling the pendulum and the part-time spring when the slide moves during the primary portion of the rearward movement of the slide, and the recoil reducer also including projections in the housing and upper and lower raceways in the pendulum slidably receiving the projections for coupling the slide with the part-time spring.

2. The system as set forth in claim 1 wherein the full-time spring is a coil spring surrounding the barrel.

3. The system as set forth in claim 1 wherein the part-time spring is a plurality of Cupped spring washers with a housing supporting the cupped spring washers.

4. The system as set forth in claim 1 wherein the coil spring is of a value operable for reducing to a maximum of 10 pounds the force necessary for an initial manual pull back of the slide prior to a first shot.

5. The system as set forth in claim 1 wherein the slide and the part-time spring are adapted to return energy to the frame as a counterbalancing force during at least a part of the secondary portion of the rearward movement of the slide.

6. A recoil reducing semi-automatic pistol system (10) for the reducing of force necessary to initially manually pull back the slide prior to a first shot being fired and the minimizing of recoil during all shots and for the returning of energy as a counterbalancing force during use, the system comprising, in combination:

a frame (14) with a grip (16) adapted to be held by a user, the frame including a trigger (18) adapted to be squeezed by the user for firing a bullet;

a fixed barrel (22) coupled to the frame, the barrel being formed with rifling;

a slide (26) slidably received upon the barrel for reciprocable movement, the slide adapted for an opening rearward movement in response to firing, the slide adapted for a closing forward movement following the rearward movement, the rearward movement including a primary portion and a secondary portion;

a coil spring (30) surrounding the barrel functioning as a full-time spring, the coil spring being of a value operable for reducing to a maximum of 10 pounds the force necessary for an initial manual pull back of the slide prior to a first shot, the coil spring adapted to assist in the abating of recoil during the entire rearward and forward movement of the slide following firing; and a recoil reducing assembly including a housing (34) with a plurality of Cupped spring washers (36) within the housing, the cupped spring washers being in combinations of series and parallel for functioning as a part-time spring operable for the abating of recoil during at least a part of the primary portion of the rearward movement of the slide and for the not abating of recoil during the secondary portion of the rearward movement of the slide, the recoil reducing assembly also including a pendulum (38) coupled to the slide for linear and rotational movement about a horizontal pivot pin (40) mounted in the slide, the pendulum being operable to initiate operation and compression of the cupped spring washers in response to movement of the slide;

the recoil reducing assembly also including a piston (44) operatively coupling the pendulum and the cupped spring washers when the slide moves during the primary portion of the rearward movement of the slide, laterally spaced left and right projections (46) in the housing, laterally spaced left and right initial upper raceways (48) and final lower raceways (50) and angled intermediate raceways (52) in the pendulum slidably receiving the projections, a central recess (54) between the left and right raceways, a firing of the firearm functioning to pivot the pendulum downwardly whereby a first rearward movement of the slide will be with the upper raceways receiving the projections and the recess receiving and pushing the piston to compress the cupped spring washers for abating recoil, and whereby a second rearward movement of the slide will be with the angled intermediate raceways receiving the projections to pivot the pendulum upwardly for disengaging the piston from the cupped spring washers to decompress the cupped spring washers, and whereby a third rearward movement of the slide will be with the projections in the final lower raceways, additional springs (56) tending to pivot the pendulum upwardly, the slide and the pendulum and the piston and the cupped spring washers adapted to return energy to the frame as a counterbalancing force during at least a part of the secondary portion of the rearward movement of the slide, the initial manual pull back of the slide being with the projections in the lower recesses and with the upper recesses not receiving the projections and with the cupped spring washes not being compressed.

* * * * *